US010843200B2

(12) United States Patent
Assmann et al.

(10) Patent No.: US 10,843,200 B2
(45) Date of Patent: Nov. 24, 2020

(54) VERTICAL ROLL MILL

(71) Applicants: THYSSENKRUPP INDUSTRIAL SOLUTIONS AG, Essen (DE); thyssenkrupp AG, Essen (DE)

(72) Inventors: Björn Olaf Assmann, Hamm (DE); Carsten Sachse, Münster (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 566 days.

(21) Appl. No.: 15/554,310

(22) PCT Filed: Feb. 25, 2016

(86) PCT No.: PCT/EP2016/053905
§ 371 (c)(1),
(2) Date: Aug. 29, 2017

(87) PCT Pub. No.: WO2016/139105
PCT Pub. Date: Sep. 9, 2016

(65) Prior Publication Data

US 2018/0078942 A1 Mar. 22, 2018

(30) Foreign Application Priority Data

Mar. 4, 2015 (DE) ..... 10 2015 203 856

(51) Int. Cl.
*B02C 15/00* (2006.01)
*B02C 23/10* (2006.01)
(Continued)

(52) U.S. Cl.
CPC ..... *B02C 15/001* (2013.01); *B02C 15/007* (2013.01); *B02C 23/10* (2013.01);
(Continued)

(58) Field of Classification Search
CPC ... B02C 15/001; B02C 15/003; B02C 15/007; B02C 2015/002; B02C 23/08; B02C 23/10; B02C 23/12; B03C 1/10; B03C 1/20
(Continued)

(56) References Cited

U.S. PATENT DOCUMENTS 3,951,347 A 4/1976 Tiggesbaumker
4,600,157 A 7/1986 Willach
(Continued)

FOREIGN PATENT DOCUMENTS

CN 201692848 U 1/2011
CN 102847587 A 1/2013
(Continued)

OTHER PUBLICATIONS

English Translation of International Search Report issued in PCT/EP2016/053905, dated May 12, 2016 (dated May 24, 2016).
(Continued)

*Primary Examiner* — Shelley M Self
*Assistant Examiner* — Katie L. Parr
(74) *Attorney, Agent, or Firm* — thyssenkrupp North America, LLC

(57) ABSTRACT

A vertical roll mill may include a grinding plate, a grinding roll, a nozzle ring that horizontally surrounds the grinding plate, an air feed apparatus disposed under the nozzle ring, a discharge element disposed below or in a region of the air feed apparatus, and a bypass apparatus disposed in the nozzle ring. The bypass apparatus may form a connection between the nozzle ring and the discharge element. Further, the bypass apparatus can discharge particles that are difficult to grind, for example, ductile particles such as iron particles, from the grinding process. In some examples, the bypass
(Continued)

apparatus includes a gas-impermeable outer skin in the region of the air feed apparatus.

17 Claims, 2 Drawing Sheets

(51) Int. Cl.
*B02C 23/12* (2006.01)
*B03C 1/10* (2006.01)
*B03C 1/20* (2006.01)

(52) U.S. Cl.
CPC ..... *B02C 23/12* (2013.01); *B03C 1/10* (2013.01); *B03C 1/20* (2013.01); *B02C 2015/002* (2013.01)

(58) Field of Classification Search
USPC ..... 241/24.14, 47, 59, 79.1, 119, 222
See application file for complete search history.

(56) References Cited

U.S. PATENT DOCUMENTS

| | | | | |
|---|---|---|---|---|
| 7,350,727 | B2 * | 4/2008 | Kronz | B02C 15/00 241/24.14 |
| 2004/0182955 | A1 | 9/2004 | Kronz | |
| 2015/0014452 | A1 | 1/2015 | Assmann | |
| 2015/0014455 | A1 | 1/2015 | Berger | |
| 2015/0151304 | A1 | 6/2015 | Guerrero Palma | |
| 2015/0196923 | A1 | 7/2015 | Guerrero Palma | |
| 2015/0258576 | A1 | 9/2015 | Hagemeier | |

FOREIGN PATENT DOCUMENTS

| | | | |
|---|---|---|---|
| CN | 203091002 | U | 7/2013 |
| DE | 920948 | C | 12/1954 |
| DE | 7038782 | A | 2/1971 |
| DE | 7234679 | U | 8/1973 |
| DE | 3344223 | A | 6/1985 |
| DE | 10141414 | A | 3/2003 |
| DE | 102012100946 | A | 8/2013 |
| DE | 102012101489 | A | 8/2013 |
| DE | 102012106553 | A | 1/2014 |
| DE | 102012107043 | A | 5/2014 |
| DE | 102012109644 | A | 5/2014 |
| JP | 1990137933 | U | 11/1990 |
| JP | 1994019833 | U | 3/1994 |
| JP | H06210193 | A | 8/1994 |
| JP | 2011088090 | A | 5/2011 |

OTHER PUBLICATIONS

English machine translation for DE7038782.
English machine translation for DE920948.
English machine translation for DE7234679.
English abstract for CN203091002.

* cited by examiner

VERTICAL ROLL MILL

CROSS REFERENCE TO RELATED APPLICATIONS

This application is a U.S. National Stage Entry of International Patent Application Serial Number PCT/EP2016/053905, filed Feb. 25, 2016, which claims priority to German Patent Application No. DE 10 2015 203 856.4 filed Mar. 4, 2015, the entire contents of both of which are incorporated herein by reference.

FIELD

The present disclosure generally relates to vertical roll mills and, more particularly, to vertical roll mills with bypass apparatuses for discharging difficult-to-grind particles from the grinding process.

BACKGROUND

In the grinding of cement, cement clinker is increasingly being replaced by further constituents, such as for example limestone, slag sand or fly ash. This has the result that the clinker component, in a decreasing fraction, must tendentially be ground more finely in order to ensure the product quality, in particular the cement strengths. It is to be expected that this trend will continue in future for economical and ecological reasons. A modern vertical roll mill must therefore be capable of processing these different feed materials in a simultaneously diversified product portfolio (individual customer demands) in order to meet the market requirements. This however has the effect that a vertical roll mill cannot be optimized for operation with a particular feed material, but rather, where possible, a series of different feed materials must be ground together or separately in the mill. The cement grinding installation should in this case be capable of being converted quickly and flexibly (without mechanical modifications) between different grinding products. It is thus necessary for suitable process and operating parameters to be found which permit energy-efficient and throughput-optimized grinding operation for all grinding materials.

In the grinding of slag sand, it is furthermore the case that a build-up of magnetic fine iron occurs on the grinding plate. Here, the build-up of fine iron on the grinding plate or on the grinding track during the grinding of slag sand or blast furnace slag cannot be prevented by means of an adaptation of the operating parameters alone. An average slag sand or blast furnace slag comprises an iron fraction in a mass fraction of between 0.3% and 0.5%.

In principle, the iron may be discharged from the mill in two ways. One variant is the discharging of the iron via the product flow. Here, the iron must be transported pneumatically to the classifier and subsequently passed through the classifier rotor in order to exit the mill with the grinding product. The high density of the iron in relation to the slag sand, and the small particle size of the product, oppose a discharge of the iron with the product flow. Thus, the pneumatic transport to the classifier is impeded, and in the classifier, the iron is preferentially repelled at the rotor owing to its relatively high density, such that said iron is fed to the plate again as grit. Owing to the ductility of the iron particles, scarcely any comminution occurs, such that the fine iron circulates and builds up in the mill.

In the second variant, the iron particles fall through the nozzle ring and are thereafter extracted from the material stream in the external material circuit by means of a magnetic separator. The second discharge possibility via the nozzle ring is however restricted only to the coarse iron particles, because the relatively fine iron particles are conveyed back to the plate owing to the high speed in the nozzle ring. By contrast, the coarse iron particles fall through the nozzle ring and are conveyed with the aid of discharge elements into the external circuit. A lowering of the speed in the nozzle ring for the ejection of fine iron particles is not expedient, because this, inter alia, has an adverse effect on the load capacity within the mill. A structural enlargement of the nozzle ring surface area (lowering of the speed in the nozzle ring) in turn impairs the operation, because the transmitted momentum is not sufficient to accelerate the product particles in the direction of the classifier. In particular during swing operation, for example during the grinding of cement clinker using the same grinding installation, the grinding process is adversely affected.

The accumulated fine iron is accordingly too coarse for the product and too fine for the transverse-flow classification at the nozzle ring. The build-up of the fine iron has an adverse effect on the wear of the grinding tools, of the mill housing and of the classifier. Furthermore, the fine iron that circulates in the mill causes an increase in the energy requirement, with an associated decrease in throughput capacity. Furthermore, the fine iron, above a certain concentration in the grinding circuit, leads to relatively intense vibrations during the operation of the mill.

DETAILED DESCRIPTION

Figure 1:
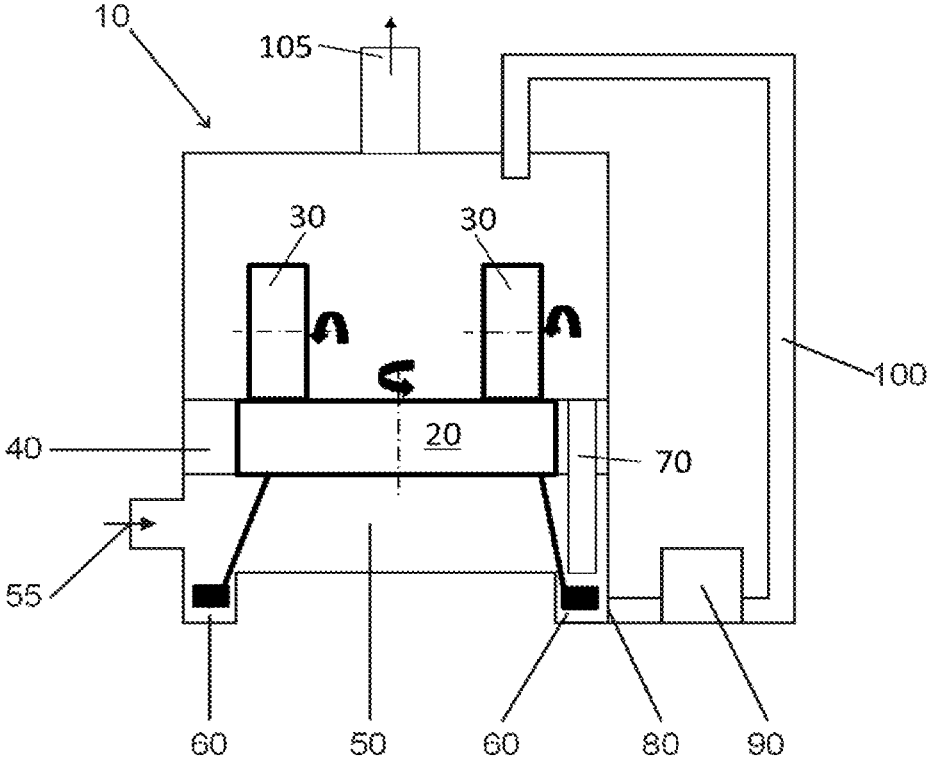
FIG. 1 is a schematic cross-sectional view of an example vertical roll mill.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention generally relates to vertical roll mills that have a bypass apparatus for discharging particles that are difficult to grind such as, for example, ductile particles such as iron particles, from the grinding process.

It is an object of the invention to provide a vertical roll mill which considerably reduces a build-up of iron on the grinding plate.

The vertical roll mill according to the invention comprises a grinding plate, at least one grinding roller, a nozzle ring, an air feed apparatus and at least one discharge element. The nozzle ring horizontally surrounds the grinding plate, which means that the nozzle ring is arranged in ring-shaped fashion around the grinding plate in the same plane. The air feed device is arranged below the nozzle ring, and the at least one discharge element is arranged below or in the region of the air feed device. The at least one discharge element is preferably arranged below the air feed device. According to the invention, the vertical roll mill comprises at least one bypass apparatus, wherein the at least one bypass apparatus forms a connection between the nozzle ring and the at least one discharge element.

The at least one bypass apparatus preferably does not make direct contact with the walls of the discharge element, because the discharge element rotates with the grinding plate and the bypass apparatus may be fixed in static fashion.

By means of the at least one bypass apparatus, a flow-calmed region is generated at the location of the bypass apparatus in the nozzle ring. In said region, practically any material can be discharged, regardless of size and specific weight, through the at least one bypass apparatus.

In this way, even iron is discharged, regardless of the particle size, from the region of the grinding plate, and a build-up can be prevented.

The bypass apparatus may for example be of tubular form with a for example circular, oval or polygonal cross section. The circular cross section is particularly preferred.

In one embodiment of the invention, the at least one bypass apparatus comprises a gas-impermeable outer skin in the region of the air feed apparatus. The gas-impermeable outer skin is for example a metal wall, a plastics wall or a composite material wall, in particular a glass fiber composite material wall or a carbon fiber composite material wall. In the context of the invention, "gas-impermeable" is to be understood here merely to mean that the outer skin is impermeable to the relatively intense gas flow in the region of the air feed apparatus, and thus generates no significant flow in the region of the nozzle ring. Questions regarding gas diffusion are therefore irrelevant in the context of this invention.

In a further embodiment of the invention, the number of bypass apparatuses corresponds to the number of grinding rolls. Alternatively, the number of bypass apparatuses corresponds to an integer multiple of the number of grinding rolls. The vertical roll mill particularly preferably comprises two to six grinding rolls and two to six bypass apparatuses.

In a further embodiment of the invention, the vertical roll mill comprises at least two bypass apparatuses. The at least two bypass apparatuses are arranged equidistantly. In the case of two bypass apparatuses, it is thus the case that these are spaced apart by 180° on the nozzle ring, and in the case of three bypass apparatuses, these are spaced apart by 120°, and in the case of four bypass apparatuses, these are spaced apart by 90°. If the vertical roll mill comprises an integer multiple of bypass apparatuses in relation to the number of grinding rolls, it is thus possible for groups of bypass apparatuses, which correspond to a number corresponding to the integer multiple, to be arranged equidistantly with respect to one another.

In a further embodiment of the invention, the at least one bypass apparatus comprises a cross-sectional area at the surface of the nozzle ring, wherein the cross-sectional area of the at least one bypass apparatus amounts to less than 2.5% of the surface area of the grinding plate.

In a further preferred embodiment of the invention, the at least one bypass apparatus comprises a cross-sectional area at the surface of the nozzle ring, wherein the cross-sectional area of the at least one bypass apparatus amounts to less than 1.0% of the surface area of the grinding plate.

In a further preferred embodiment of the invention, the at least one bypass apparatus comprises a cross-sectional area at the surface of the nozzle ring, wherein the cross-sectional area of the at least one bypass apparatus amounts to less than 0.5% of the surface area of the grinding plate.

The at least one bypass apparatus self-evidently adversely affects the functioning and thus the efficiency of the nozzle ring. In particular, product is also discharged through the at least one bypass apparatus. Therefore, an excessively high bypass rate, which would arise as a result of an excessively large cross-sectional area of the at least one bypass apparatus, is not expedient.

In a further embodiment of the invention, the at least one bypass apparatus comprises a cross-sectional area at the surface of the nozzle ring, wherein the cross-sectional area of the at least one bypass apparatus amounts to at least 0.01% of the surface area of the grinding plate.

In a further embodiment of the invention, all of the bypass apparatuses together comprise a cross-sectional area at the surface of the nozzle ring, wherein the cross-sectional area of all of the bypass apparatuses together amounts to less than 2.5% of the surface area of the grinding plate.

In a further embodiment of the invention, the sum of all of the cross-sectional areas of all of the bypass apparatuses at the surface of the nozzle ring amounts to less than 10% of the surface area of the nozzle ring.

In a further preferred embodiment of the invention, the sum of all of the cross-sectional areas of all of the bypass apparatuses at the surface of the nozzle ring amounts to less than 5% of the surface area of the nozzle ring.

In a further embodiment of the invention, the bypass apparatus comprises a largest cross section of less than 250 mm. For example, in the case of a circular cross section, the largest cross section is to be understood to mean the diameter, and in the case of a rectangular cross section, the largest cross section is to be understood to mean the diagonal between opposite corners. The largest cross section thus constitutes the largest dimension that the cross section of a particle can have in the same plane such that the particle can pass through the bypass apparatus.

In a further preferred embodiment of the invention, the bypass apparatus comprises a largest cross section of less than 200 mm.

In a further preferred embodiment of the invention, the bypass apparatus comprises a largest cross section of less than 100 mm.

In a further embodiment, the bypass apparatus comprises a largest cross section of at least 20 mm.

In a further embodiment, the bypass apparatus comprises a largest cross section of at least 40 mm.

In a further embodiment of the invention, a separator is arranged downstream of the discharge element. The separator is preferably a magnetic separator, and the magnetic separator is particularly preferably selected from the group comprising drum-type magnetic separator and overbelt magnetic separator.

In a further embodiment of the invention, a material return line to the grinding plate is arranged downstream of the separator. By means of the separator, it is possible in particular for the iron to be removed. The other components generally comprise the starting material or the product, such that these are advantageously fed to the grinding plate again.

In a further embodiment of the invention, the bypass apparatus comprises a larger cross-sectional area at the upper end at the nozzle ring than at the lower end at the discharge element.

For example, the bypass apparatus is of conical design. This has the advantage that, as a result of the relatively small diameter at the lower end, less air can pass from the air feed device via the discharge element into the bypass apparatus, and thus the flow region above the bypass apparatus can be calmed in a particularly efficient manner.

In a further embodiment of the invention, the bypass apparatus is arranged within a region, which exhibits a below-average throughflow, of the air feed apparatus. This arrangement, too, has the effect that less air can pass from the air feed device via the discharge element into the bypass apparatus, and thus the flow region above the bypass apparatus can be calmed in a particularly efficient manner. The bypass apparatus is particularly preferably situated in a region which exhibits a sufficient ejection of material from the grinding plate. In this context, "sufficient" is to be understood to mean a region which exhibits locally above-average ejection of material.

In a further embodiment of the invention, the discharge element comprises a closure flap and the bypass apparatus is at a maximum distance of 950 mm from the bottom edge of the discharge element. As a result of the relatively small spacing, less air can pass from the air feed device via the discharge element into the bypass apparatus, and thus the flow region above the bypass apparatus can be calmed in a particularly efficient manner.

In a further preferred embodiment of the invention, the discharge element comprises a closure flap and the bypass apparatus is at a maximum distance of 750 mm from the bottom edge of the discharge element.

In a further preferred embodiment of the invention, the discharge element comprises a closure flap and the bypass apparatus is at a maximum distance of 550 mm from the bottom edge of the discharge element.

In a further embodiment of the invention, the vertical roll mill comprises an axis of symmetry, particularly preferably a threefold axis of rotation ($C_3$ in Schoenflies notation), a fourfold axis of rotation ($C_4$ in Schoenflies notation) or a sixfold axis of rotation ($C_6$ in Schoenflies notation).

Figure 2:
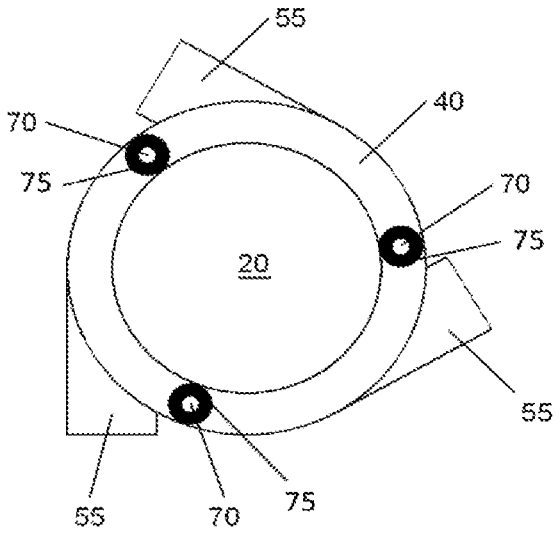
FIG. 2 is a schematic plan view of an example vertical roll mill.

FIG. 1 shows a schematic cross section of the vertical roll mill 10, and FIG. 2 shows a schematic plan view onto the plane of the grinding plate 20. The grinding plate 20 comprises for example a diameter of approximately 4.5 m, and the nozzle ring 40 comprises a width of approximately 40 cm. In this exemplary vertical roll mill 10, three grinding rolls 30, of which only one is visible in FIG. 1, are situated above the grinding plate 20. Situated below the nozzle ring 40 is the air feed device 50, into which air is introduced by three air inlets (visible in FIG. 2), which air rises upward through the nozzle ring 40 and discharges the ground product from the vertical roll mill 10. In the region of the air feed device 50 there is arranged a discharge element 60 in which material that falls through the nozzle ring 40 is captured. Said material generally comprises large and relatively heavy particles. These are fed through a closure flap 80 to a separator 90. In the separator 90, which in this example is designed as a magnetic separator, iron particles are removed. The remaining material is fed via the return line 100 back to the grinding plate 20. Furthermore, the vertical roll mill 10 comprises an air outlet 105. This construction corresponds in this respect to a vertical roll mill according to the prior art.

The vertical roll mill 10 according to the invention additionally comprises, in the example shown, three bypass apparatuses 70 which lead from the nozzle ring 40 into the discharge element 60. Since the discharge element 60 is designed in the form of a depression below the air feed device 50, said region exhibits reduced flow, whereby only very little air is conducted from the air inlet 55 through the air feed device 50, the discharge element 60 and the bypass apparatuses 70. As a result, the flow above the bypass apparatuses 70 is greatly reduced, and it is thus possible for even small and relatively lightweight iron particles to be discharged through the bypass apparatuses 70.

As emerges from FIG. 2, the bypass apparatuses 70 are oriented with a maximum spacing in terms of flow to the three air inlets 55. In this way, the air flowing through the bypass apparatuses 70 is additionally reduced.

Figure 3A:
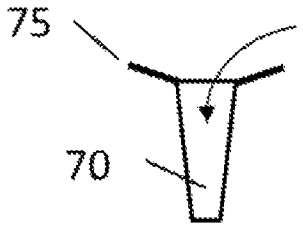
FIG. 3 is a schematic view of an example bypass apparatus.
Figure 3B:
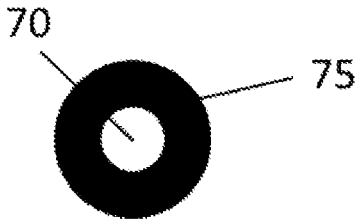

FIG. 3 shows a bypass apparatus 70, wherein the bypass apparatus 70 comprises, in the upper region, additional material-guiding panels 75 which, in the region of the nozzle ring 40, increase the introduction of material into the bypass apparatus 70. FIG. 3*a* shows, in cross section, the funnel function of the material-guiding panel 75, and FIG. 3*b* clearly shows, in plan view, the relationship between the diameter of the bypass apparatus 70 and that of the material-guiding panel.

REFERENCE DESIGNATIONS

10 Vertical roll mill
20 Grinding plate
30 Grinding roll
40 Nozzle ring
50 Air feed device
55 Air inlet
60 Discharge element
70 Bypass apparatus
75 Material-guiding panel on bypass apparatus
80 Closure flap
90 Separator
100 Return line
105 Air outlet

What is claimed is:

1. A vertical roll mill comprising:
a grinding plate;
a grinding roll;
a nozzle ring disposed around the outer periphery of, concentric with, and in the same plane as, the grinding plate;
an air feed apparatus disposed under the nozzle ring;
a discharge element disposed below and outside a region of the air feed apparatus, and configured to rotate with the grinding plate; and
a bypass apparatus fixedly disposed in a static fashion in the nozzle ring, the bypass apparatus forming a connection between the nozzle ring and the discharge element, the bypass apparatus having a ring-shaped material-guiding panel disposed at an upper end thereof, which material-guiding panel has an outer diameter greater than a diameter of the upper end of the bypass apparatus and is configured to increase introduction of materials into the bypass apparatus.

2. The vertical roll mill of claim 1 wherein the bypass apparatus comprises a gas-impermeable outer skin in the region of the air feed apparatus.

3. The vertical roll mill of claim 1 wherein the bypass apparatus is one of a plurality of bypass apparatuses and the grinding roll is one of a plurality of grinding rolls, wherein a quantity of the plurality of bypass apparatuses corresponds to a quantity of the plurality of grinding rolls.

4. The vertical roll mill of claim 1 wherein the bypass apparatus comprises at least two bypass apparatuses disposed equidistantly within the nozzle ring such that each of the at least two bypass apparatuses is equidistant from the adjacent bypass apparatus in both directions along a circumference of the nozzle ring.

5. The vertical roll mill of claim 1 wherein the bypass apparatus comprises a cross-sectional area at a surface of the nozzle ring, wherein the cross-sectional area of the bypass apparatus amounts to less than 2.5% of a surface area of the grinding plate.

6. The vertical roll mill of claim 1 wherein the bypass apparatus comprises a cross-sectional area at a surface of the nozzle ring, wherein the cross-sectional area of the bypass apparatus amounts to less than 1.0% of a surface area of the grinding plate.

7. The vertical roll mill of claim 1 wherein the bypass apparatus comprises a cross-sectional area at a surface of the nozzle ring, wherein the cross-sectional area of the bypass apparatus amounts to less than 0.5% of a surface area of the grinding plate.

8. The vertical roll mill of claim 1 wherein the bypass apparatus is one of a plurality of bypass apparatuses, wherein a sum of all cross-sectional areas of the plurality of bypass apparatuses at a surface of the nozzle ring amounts to less than 10% of a surface area of the nozzle ring.

9. The vertical roll mill of claim 1 wherein the bypass apparatus is one of a plurality of bypass apparatuses, wherein a sum of all cross-sectional areas of the plurality of bypass apparatuses at a surface of the nozzle ring amounts to less than 5% of a surface area of the nozzle ring.

10. The vertical roll mill of claim 1 wherein a largest cross section of the bypass apparatus is less than 250 mm.

11. The vertical roll mill of claim 1 wherein a largest cross section of the bypass apparatus is less than 20 mm.

12. The vertical roll mill of claim 1 further comprising a separator disposed downstream of the discharge element.

13. The vertical roll mill of claim 12 further comprising a material return line to the grinding plate, the material return line being disposed downstream of the separator.

14. The vertical roll mill of claim 12 wherein the separator is a magnetic separator.

15. The vertical roll mill of claim 14 wherein the magnetic separator is either a drum-type magnetic separator or an overbelt magnetic separator.

16. The vertical roll mill of claim 1 wherein the bypass apparatus comprises a larger cross-sectional area at an upper end at the nozzle ring than at a lower end at the discharge element.

17. The vertical roll mill of claim 1 wherein the bypass apparatus is disposed within a region of the air feed apparatus that exhibits a below-average throughflow of air within the air feed apparatus.

* * * * *